United States Patent [19]

Wiegel

[11] Patent Number: 4,942,938

[45] Date of Patent: Jul. 24, 1990

[54] SPACE UNIT FOR THE RECORDING AND/OR REPRODUCTION OF ACOUSTIC SIGNALS

[76] Inventor: Thomas Wiegel, Wielandstrasse 13, 1000 Berlin 41, Fed. Rep. of Germany

[21] Appl. No.: 87,773

[22] Filed: Aug. 21, 1987

[30] Foreign Application Priority Data

Aug. 22, 1986 [DE] Fed. Rep. of Germany ..... 3628590

[51] Int. Cl.[5] ..... E04B 1/99

[52] U.S. Cl. ..... 181/30; 181/295

[58] Field of Search ..... 181/30, 295

[56] References Cited

U.S. PATENT DOCUMENTS 1,238,228 8/1917 Weil ..... 181/30 X
3,180,446 4/1965 Wenger ..... 181/30
3,630,309 12/1971 Wenger et al. ..... 181/30
4,278,145 7/1981 Eade et al. ..... 181/30

FOREIGN PATENT DOCUMENTS 3419888 11/1985 Fed. Rep. of Germany .
1500960 10/1967 France .
2165351 8/1973 France .

*Primary Examiner*—Benjamin R. Fuller
*Attorney, Agent, or Firm*—Andrus, Sceales, Starke & Sawall

[57] ABSTRACT

A space unit for the recording and/or reproduction of acoustic signals on and/or from sound carriers is described. The space unit is formed as transportable space cell which is adapted to be installed in closed rooms or out of doors. Recording means and/or reproduction means for the acoustic signals are located within the space unit, and the same offers space for at least one person. The space unit is in the shape of a sphere, of a regular, sphere-like polyeder or of a part thereof.

11 Claims, 3 Drawing Sheets

Figure 1:
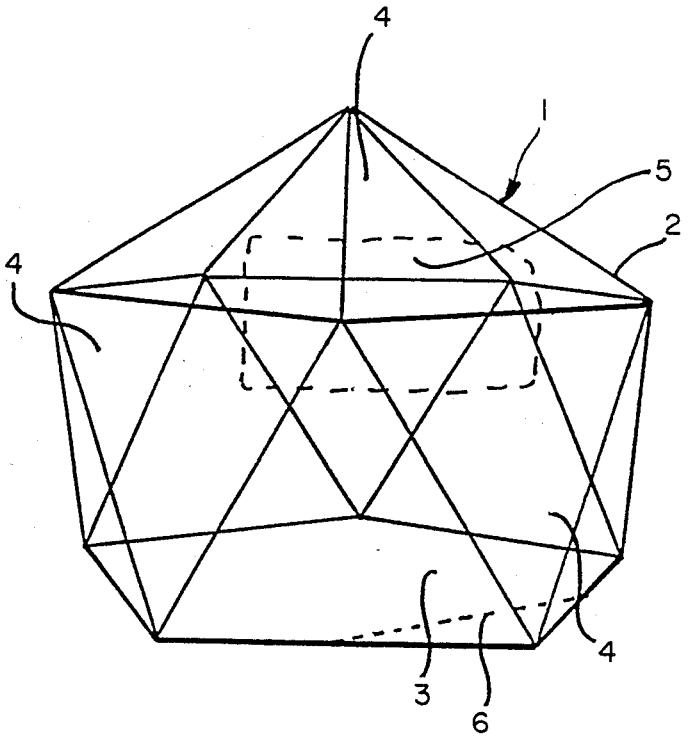

FIG 3
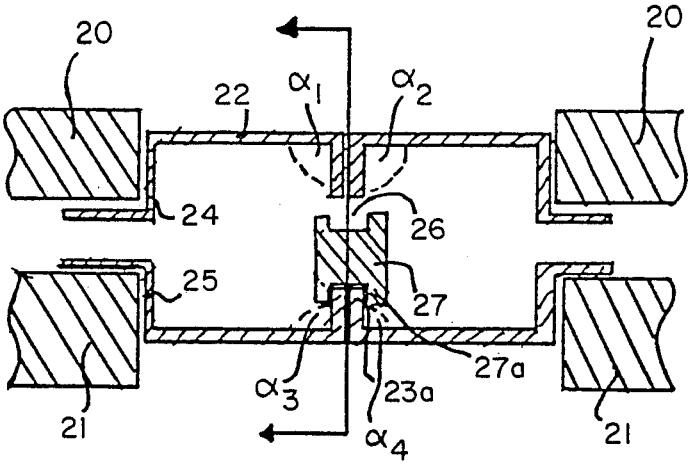
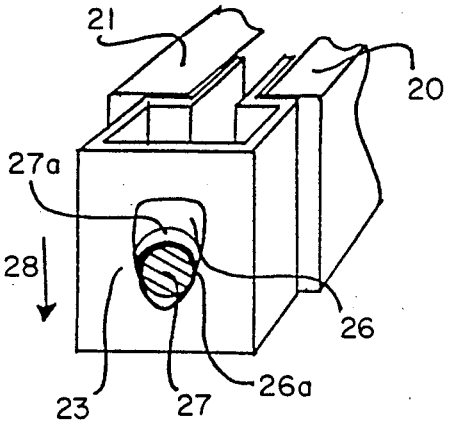
FIG 4

SPACE UNIT FOR THE RECORDING AND/OR REPRODUCTION OF ACOUSTIC SIGNALS

The present invention concerns a space unit for the recording and/or reproduction of acoustic signals.

Normally, sound studios are used for the recording of acoustic signals for instance music or language performances, on sound carriers, for instance magnetic record tapes, disks or compact disks, which are designed in a special manner and which are constructed with correspondingly high expenses. On account of the relativelY high costs of manufacture of such sound studios they are normally present only with more important broadcasting companies or with the manufacturers of recorded sound carriers. This has the result that these sound studIos are occupied for a long time and that their costs of rent are correspondingly high.

The sound carriers recorded in the above-described sound studios are reproduced on very expensive equipment. However, when doing this it is not taken into consideration that also the respective space in which the reproduction system is located influences the quality of reproduction in a decisive manner. This brings along the result that indeed the above-mentioned sound carriers are recorded with high expenditure however that the optimum variety oF sound and intensity oF sound are not fully effective on account of the respective spacial circumstances.

It is the object of the invention to provide a space unit of the cited kind which enables the recording and/or reproduction of acoustic signals in an especially simple manner with special emphasis on the quality of recording and/or reproduction.

This object is attained by a space unit with the characterizing features of patent claim 1.

The invention is based on the principal idea to carry out the recording and/or reproduction of acoustic signals on and/or from sound carriers in a space unit which is formed as a transportable space cell. The inventive space cell is set up either in closed room a or out of doors and includes recording and/or reproduction means for the acoustic signals for instance music, language etc. which are located in the interior thereof. Within the space cell there is space for at least one person who produces and/or hears the acoustic signals. On account of the special shape of the space cell which is formed as a sphere regular sphere-like polyhedron or part thereof, optimum acoustic conditions are made possible which bring along an excellent quality of recording and/or of reproduction of the acoustic signals which have to be recorded or which are recorded. The ground for this is seen in the generation of a natural sound field to which the person using the space cell is exposed from all sIdes and which results from the special shape of the limiting surfaces of the space cell and which consists oF an ideal mixture of direct sound, diffusive sound and sound resonances.

If the inventive space unit is used For the recording of acoustic signals on sound carriers the recorded signals are rich in detail, have a good sound balance as well as a natural additive spaciousness. Also when reproducing acoustic signals, especially music, recorded on sound carriers the inventive space unit oFFers agaIn richness in detail, sound neutrality as well as a natural additive spaciousness i. e. conditions which enable a reproduction according to the orIginal in all aspects and which are comparable only with expensively designed and equipped sound studios or which even exceed the same.

Furthermore, the Inventive space unit has additional advantages. It eliminates all the disturbing noise, as for instance street noise, noise from adjoining rooms etc., and prevents at the same time that noIse from the interior oF the space cell penetrates to the outside. Accordingly the inventive space unit may be used in an ideal manner For tests, for instance of bands or soloists, the development of noIse oF which is often felt disturbing by the coinhabitants. Furthermore the room cell renders possible the hearing of acoustic signals, as for instance music recorded on sound carriers in a manner completely isolated From the envIronment so that it can be used in an excellent manner For an acoustic comparison of different reproduction means, for instance stereophonic systems, or for the hearing oF recorded music, as for instance disks compact disks which are normally heard at present by means oF head receivers which are felt as disturbing. It is also possible to use the inventive space unit for the tuning of musical instruments as for instance grand pianos of high value or strings. On account of the easy shIpping of the space unit, this has to be only installed over the grand piano which has to be tuned so that such an expensive and heavy instrument has not to be shipped. Furthermore, with the space unit simultaneous teaching of several soloists in one room is possible. For this it is only necessary that in this room a number of space cells corresponding to the number oF soloists is provided. By means of the space unit with regard to richness in detail, sound balance as well as the additive spaciousness completely new sound carrIers can be manuFactured. When doing this, individual soloists and/or soloist groups are in a space cell and the music produced herefrom with optimal acoustic conditions is supplied to the reproduction means by means of corresponding mixing means so that a reproduction of the musical compositions recorded in this manner brings along results which are excellent particularly with regard to acuteness of locating and extent of fullness of the individual musical instruments or instrument groups and spaciousness so that a reproduction quality is attained that corresponds to a live concert in a large cathedral with an excellent acoustic without disturbing interference noise which is always present with such a concert. Furthermore, iF the recording is controlled in a space unit and is later reproduced even a transfer is guaranteed which is absolutely free of losses.

A further embodiment oF the inventive space unit provides a space cell in the shape oF a truncated cone or oF a truncated polyhedron.

If the space cell is shaped as truncated sphere preferably a location is selected for the plane of section which is situated below the center of the sphere so that a space cell results which is larger than a semi-sphere. In such a space cell the above-described sound field responsible for the excellent acoustic characteristics of the space cell concentrates to a central region of the sphere segment which in response to the size of the respective sphere segment extends over about one fifth up to about two thIrds oF the height oF the sphere segment and approximately to the same extent over the diameter of the section plane of the sphere segment. With increasing size of the sphere segment also the central region increases so that with room cells of a large volume which especially serve for the reception of a greater number of persons correspondingly large sound fields are present.

The same is true for the truncated polyhedron which is similar in its shape to the above-described sphere segment.

With a preferred embodiment of the space unit the space cell has the shape oF a truncated icosahedron. Here, the icosahedron is out oFF such that it has a regular pentagon as a base while the remaining surfaces of the polygon consist of equilateral triangles. The length of the edge of the regular pentagon corresponds to the length of the side of the equilateral triangle. Such a space cell is especially suited For the recording and/or reproduction of the acoustic signals since these, on account of the special location of the surfaces of the polygon are reflected especially well Into a central region oF the space cell so that sound fields result here which produce an optimal spacial sound feeling for the user or the users not only during the recording but also during the reproduction. Furthermore, such a space cell has a good appearance so that it can be integrated into a living room without any problems and without being felt disturbing by the resident. Practically, with such a space unit the recording means and/or the reproduction means for the acoustic signals are installed in the central region into which the sound field is concentrated. Especially well suited is an installation of the recording means and/or reproduction means in the upper third of the central region since by such an arrangement the best results may be received according to the present research.

In order to enable an easier enterIng or leaving of the space cell with the above-described embodiment, according to a further embodiment the above-cited icosahedron segment is cut perpendicularly to its base such that with the formation oF a hexagonal base a room cell having a rectangular wall section results which, with the exception of the rectangular waIl section and the two adjacent surfaces which are rectangular triangles, has the shape of the above-described icosahedron segment, the rectangular wall section serves for the reception of a door member extending ccmpletely or partly over the wall section. It is self-evident that also in the horizontal rectangular wall section two or more door members can be arranged. As the tests show, the acoustic conditions within the space cell are not modified by such an arrangement of such a horizontal wall section.

In order to enable a satisfactory enterIng or leaving of the room cell especially with such embodiments of the inventive space until which are installed within closed rooms, for instance in a residence, a special embodiment has a door member located in the rectangular wall section which extends further upwardly into the equilateral triangle located above the door member and covers a region of the same. By this it is attained that the door member has a height of passage of about 200 cm which would not be secured with an embodiment according to which the door member extends only about the height of the rectanguIar wall section on account oF the height of the living room of about 250 cm customarily present with dwelling rooms. Such an upward enlargement oF the door member does not change the acoustic condition a or the space cell.

Preferably, the Inventive room unit is adapted to be simply mounted or demounted so that it can be installed at any location with relatively moderate means. If the space unit is to be installed for instance in a residence, normally the installation of a base or basic plate can be eliminated since here the floor takes over the function of the base or the basic plate. OF course, it is also possible lo provide the space unit with a corresponding base so that a space cell closed at all sides results. Preferably, the base is formed as a base plate. However, other base constructions are also possible. A space cell closed at all sides is to be preferred, especially where the existing floor surface, which may be for instance the Floor oF a room or when using the space unit out of doors the natural ground negatively influences the reflection oF the acoustic signals.

In order to assure a simple and quick mounting or demounting of the inventive space unit there are on principle two possibilities. According to the first possibility, the space unit has a framework the struts of which consist for instance of correspondingly shaped metal profiles. The struts are connected at their contact surfaces with one another, for instance by means of screws, inserts, plugging etc. Suitable surFaces preferably correspondingly shaped plates are located between the struts of the rramework. These are mounted to the structure of the framework.

According to the second possibility, the individual surfaces by which the space cell is formed have ledge members at their edges, respectively, which extend partially or completely over the length of the edges. Here, the individual surfaces are connected with one another by means of connectors provided at the ledges for assembling the space cell. Accordingly, such a space cell has a self-supporting construction. An especially preferred embodiment of the space unit has connectors which are adapted to be connected by means oF clamping engagement so that such a space unit can be simply and quickly assembled or disassembled without using tools. These connectors are preferably formed as one-sided narrowing recesses in the ledges so that adjacent surfaces of the space cell are connected by means of bolts which are in clamping engagement with the narrowing areas of the recesses.

Any customarily used building material, as for instance gypsum plates chip boards, glass, plastic boards etc., can be used as material for the space cell. Especially good results can be attained if the space cell is made of boards which are provided with a sound absorbing layer on their outside and with a sound reflecting layer on their inside since by this exterior noise sources are especially well blocked oFF and an excellent acoustics can be attained in the interior of the space cell. However, the resonance properties of the wall surfaces have to he adjusted to the used recording units and reproduction units. As a sound absorbing layer the customary materials may be used, for instance foamed plastics, mineral fiber, insulating board etc. As a sound reflecting layer hardened plastics, glass, metal plates etc. can be used. However, it is also possible to use plates that have only an outer sound absorbing layer or an inner sound reflecting layer.

In order to prevent an undesired disturbing influence of the recording means and/or reproduction means provided in the space cell on the acoustic conditions of the space cell, these means are preferably located in specially formed supporting means. This supporting means consists of a framework which has the shape oF a pyramid provided with curved edges.

Further embodiments of the inventive space unit are indicated in the subclaims.

Figure 2:
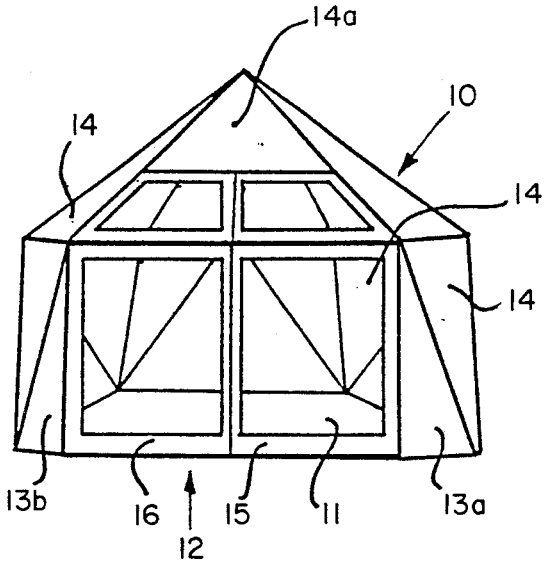

In the following the invention is explained in detail by means of examples in connection with the drawing. The following figures show:

FIG. 1 a perspective view of a first embodiment in which the surfaces are removed for a better presentation;

FIG. 2 a perspective view of a second embodiment;

FIG. 3 a section through a connector; and

FIG. 4 a perspective view along section line in FIG. 3.

FIG. 1 shows a first embodiment of the space unit which has a space cell which is designated with 1 in general. The space cell I has the shape of a truncated (cut off) icosahedron which comprises as a base a regular pentagon as well as 15 polygon surFaces 4 which consist of equilateral triangles. For a better perspective presentation only the edges of the polygon surfaces are shown. Non-shown recording means and/or reproduction means are provided within the space cell 1. These means are located within a region 5 of the space cell I. On account of the special shape oF the space cell the acoustic signals produced therein or reproduced therein are reflected to a central region or area of the space cell with the formation of an optimum sound field. Depending on the respective size of the space unit this central region or area comprises about 30% to about 70% of the volume of the space cell.

If one cuts the space unit shown in FIG. 1 perpendicularly with respect to the line 6 shown in this figure, one comes to the second embodiment shown in FIG. 2. This space unit comprises a space cell generally designated with 10 which has a hexagonal base 11, a rectangular vertical wall section 12, two laterally adjoining right triangles 13*a*, 13*b* and 12 equilateral triangles 14 of which only some are designated. As already described in the foregoing, recording means and/or reproduction means are also provided in the space cell 10. These means are located within the space cell 10 in a region which approximately corresponds to the region 5 in FIG. 1. Two door members 15 and 16 are provided in the forward vertical rectangular wall section 12. The linings of these door members consist of glass and thus cause exposure of the space cell 10. The space cell 10 shown in FIG. 2 is an embodiment which is preferably installed in dwelling rooms. In order to assure a sufficient door height, the door member 15, 16 extend further upwardly into the equilateral triangle 14*a* located thereabove and cover an area of the same. In the embodiment shown in FIG. 2 the base 11 as well as the surfaces of the triangles 13*a*, 13*b* and 14 as well as 14*a* consist of two gypsum boards, respectively, and the individual surfaces are connected with one another at theIr edges by means of ledge members and connectors shown in the FIGS. 3 and 4 in detail.

As one can take from FIGS. 3 and 4, a ledge member 22 is provided at each edge of the boards 20 or 21, said ledge member having at its forward portion a connector 23 integrally formed with the ledge member. The ledge member 22 has two angle portions 24 and 25 which serve for the fastening of the gypsum boards 20 or 21. In an opposite portion of the ledge member 22 a recess 26 is provided which has a lower restricted portion 26*a*. The recess 26, 26*a* as well as a boIl 27 located therein form the connector 23.

As shown in FIG. 3 the boards 20 and 21 are spaced from one another. By this the possibility exists to provide additional sound absorbing material between the boards. Of course instead oF the two boards 20 or 21 shown in FIG. 3 only one board can be provided.

In order to assemble the space cell 10 shown in FIG. 2 which has a self supporting construction, the surfaces which have to be connected are aligned with one another such that their ledge members 22 and their connectors 23 abut as shown In FIG. 3, prior to this the bolt 27 was inserted into one of the connectors and was brought into clamping engagement with the restricted portion 26*a* of the recess 26 by movement in the direction of the arrow 28 (FIG. 4) so that movement of the other connector in the direction of the arrow 28 causes a connection of the two surfaces without necessitating a tool for this. In order to prevent sliding cf the bolt 27 out of the recess 26, this has an annular bead 27*a* at each of its two ends which is engageable with a portion 23*a* of the connector. OF course, it is also possible to fasten the bolt in the position shown in FIG. 4, for instance by welding with the portion 23*a*.

The connector shown in FIG. 3 allows a straight-line connecting of surfaces. If connecting of surfaces with respect to other angles is necessary, it is only requested to modify the angles $\alpha_1$ to $\alpha_4$ shown in FIG. 3 in a corresponding manner.

An embodiment oF the inventive space cell which is formed as truncated sphere or as truncated polyhedron has the advantage of better acoustic properties compared with an embodiment which is a complete sphere since with a sphere resonances are generated approximately in the center thereof. Such a formation of resonances is prevented with bodies which are cut-off in a corresponding manner. Accordingly, of the inventIve solutions such an embodiment is preferred.

If the inventive space cell is formed as icosahedron, the location of the section plane is predetermined by the shape of the isoahedron. With a truncated sphere the section plane is approximately located at a position corresponding to a comparable ioosahedron.

In the foregoing an embodiment was described according to which not only the recording means but also the reproduction means are located centrally within the space cell. However, it was observed that even better results may be attained if the recording means are located approximately centrally while the reproduction means are located with the same distance to the center within the space cell respectively. The term "center" means the imaginary center of the space cell or of the truncated sphere or oF the truncated polyhedra. The distance which has to be selected for each case depends can the total dimension. Also a corresponding distance with respect to the wall of the space cell has to be observed.

With regard to the constructive design of the space cell in the foregoing an embodiment was described according to which the inner portion oF the waIl was associated with sound reflecting properties while the outer portion of the wall was associated with sound absorbing properties. However, such a separation is not absolutely necessary. The total wall structure may be rather formed in a sound absorbing manner, and the inner surface may have additionally sound reflecting properties.

In addition to the structure oF the profiles it has to be still mentioned that the construction of the corresponding material of the profiles can be also attained by resiliency.

Finally, it has to be noted that the inventive space cell is suited not only for customary sound carriers but also for other new mediums (ISDN-system).

According to a further inventive solution the framework comprises hollow struts which are provided with openings. Especially for the case when the framework is selfsupporting and is made from profile tube, the volume generated hereby, i.e. the volume of the hollow space of the framework, can be used for resonator functions wherein the provided openings function as resonator openings. It is especially appropriate to provide these resonator openings in the corners or at the edges of the space cell. Accordingly, the framework or parts thereof have the function of a Helmhollz resonator.

I claim:

1. A transportable, acoustical space cell (1, 10) for containing sound produced therein, said space cell adapted to be installed in closed rooms or out of doors for surrounding at least one of a means for recording sounds or a means for reproducing sounds, said space cell being closed on all sides and comprising a structure of truncated icosahedral configuration, said space cell being larger in size than a hemi-hedron, said truncated icosahedral structure having an interior volume and interacting with the sound existing in said cell to form a sound field within said space cell in which an ideal mixture of directly transmitted sound characteristics reflected sound characteristics, and sound characteristic resulting from resonance of the structure occur, said sound field occupying approximately 30% and 70% of the interior volume of said space cell and being located substantially at a center of said space cell, said recording means or reproducing means being locatable within said sound field.

2. The space cell according to claim 1 wherein said space cell structure (1, 10) has a vertical wall portion (12) containing at least one door member (15, 16).

3. The space cell according to claim 2 including two door members (15, 16) located in said vertical wall portion (12).

4. The space cell according to claim 1 wherein said space cell structure has a hexagonal base (11) and is formed of a rectangular wall comprising a vertical wall portion (12) containing at least one door member (15, 16) and having side edges, two right triangular walls (13*a*, 13*b*) adjoining said side edges of said rectangular wall, and twelve equilateral triangular walls (14, 14*a*) forming a remainder of the truncated icosahedral configuration of said space cell.

5. The space cell according to claim 4, wherein said door member (15, 16) extends into at least one of said equilateral triangular walls located above said vertical wall portion so that at least one of said equilateral triangular walls include a portion of said door member.

6. The space cell according to claim 1 wherein said space cell (1, 10) is formed such that said space cell can be disassembled.

7. The space cell according to claim 1 further defined as an assemblable and disassemblable space cell, wherein said space cell structure (1, 10) has a plurality of abutting sheet-like wall elements (14, 14*a*) having edges, said edges being provided with respective ledge members 922) which are connectable with one another or disconnectable from one another thereby to permit assembly or disassembly of said space cell (1, 10).

8. The space cell according to claim 7, wherein said ledge members (22) are associated with connectors 923) which are adapted to be connected by clamping engagement.

9. The space cell according to claim 8, wherein said connectors (23) are formed as tapering recesses (26) provided in said ledge members (22), and wherein abutting elements (14) of said space cell (10) are connected by means of bolts (27) located in said recesses (26).

10. The space cell according to claim 1, wherein said space cell structure has a framework comprising struts and has wall elements located between said struts and mounted thereto.

11. The space cell according to claim 1 wherein said space cell structure has wall elements comprising an outer sound absorbing layer and an inner sound reflecting layer.

* * * * *